United States Patent [19]

Ruud et al.

[11] 4,344,111

[45] Aug. 10, 1982

[54] HIGH EFFICIENCY LIGHTING UNITS AND SYSTEMS USING SAME

[75] Inventors: Alan J. Ruud, West Allis, Wis.; Ian Lewin, Scottsdale, Ariz.

[73] Assignee: McGraw-Edison Company, Rolling Meadows, Ill.

[21] Appl. No.: 176,717

[22] Filed: Aug. 8, 1980

Related U.S. Application Data

[62] Division of Ser. No. 862,579, Dec. 20, 1977, Pat. No. 4,229,782.

[51] Int. Cl.[3] ..... A61G 13/00

[52] U.S. Cl. ..... 362/33; 362/147; 362/350; 362/153; 362/241; 362/247; 362/249; 362/297; 362/346

[58] Field of Search ..... 362/33, 97, 241, 247, 362/249, 250, 297, 298, 346, 347, 350, 804, 147, 153

[56] References Cited

U.S. PATENT DOCUMENTS

| | | | |
|---|---|---|---|
| 2,447,923 | 8/1948 | Tuck | 362/347 X |
| 3,374,342 | 3/1968 | Hutchins | 362/250 X |
| 3,928,757 | 12/1975 | Nelson | 362/247 X |
| 3,944,810 | 3/1976 | Grindle | 362/297 |
| 4,218,727 | 8/1980 | Shemitz et al. | 362/346 X |
| 4,236,193 | 11/1980 | Brandt | 362/249 X |
| 4,237,528 | 12/1980 | Baldwin | 362/347 X |

*Primary Examiner*—Peter A. Nelson

*Attorney, Agent, or Firm*—Ronald J. LaPorte; Jon Carl Gealow; Charles W. MacKinnon

[57] ABSTRACT

A lighting unit comprising a lamp and a reflector provides high intensity, high efficiency, even illumination over an area of particular shape and size and has a cut-off angle which enables a person to approach close to the lighting unit without seeing the lamp or its reflection. The reflector comprises at least two spaced apart curved reflector surfaces which join each other along an edge line in a plane behind and spaced from the lamp. Points on the curve line of each reflector surface are spaced progressively farther away from the lamp than the edge line. Some points on the curve are located on the side of the plane remote from the lamp. The lighting unit, which may employ reflector surfaces in addition to those above mentioned, may be employed in systems wherein it projects light upwardly for downward reflection from a ceiling or projects light downwardly directly onto a work surface. The lighting units located in some systems are so that the reflector opening is near eye level of a standing or sitting person.

7 Claims, 16 Drawing Figures

HIGH EFFICIENCY LIGHTING UNITS AND SYSTEMS USING SAME

This is a division of application, Ser. No. 862,579, filed Dec. 20, 1977, now U.S. Pat. No. 4,229,782.

BACKGROUND OF THE INVENTION

1. Field of Use

This invention relates generally to high intensity high efficiency lighting units comprising a lamp and reflector and to lighting system using the same. In particular, it relates to reflectors for such lighting units and systems.

2. Description of the Prior Art

Effective illumination of interior spaces and work surfaces in offices, reception rooms, libraries, homes, and so forth, requires consideration of the desired distribution of light, area-wise and space-wise, and consideration of the efficiency, location, electromechanical features, and esthetics of the lighting unit itself. High intensity, high efficiency lighting units which provide even light distribution throughout an area or on a specific work surface but which do not disturb the vision of a person near the unit are often preferred.

It may be desirable, for example, for the lighting unit to project light downwardly directly onto a large work area, such as a room, or onto a small work surface, such as a desk. Or, it may be desirable that the lighting unit project light upwardly for reflection downwardly from the ceiling for general lighting purposes. In any case, the light should be distributed as evenly and as efficiently as possible over an area of predetermined size and shape. Also, the lighting unit, however mounted, should be at an elevation close enough to illuminate the area effectively and efficiently, and if such elevation is near the eye level of a person nearby, the unit should be designed so that the person can be quite close to the lighting unit without seeing the lamp or its reflection.

U.S. Pat. No. 3,389,246 shows a lighting unit located near eye level of a standing person for simultaneously directing light downwardly onto a work surface and upwardly for reflection from the ceiling. In one embodiment, the lighting unit includes a fluorescent lamp tube and employs louvered devices or baffle deflectors for directing the light upwardly and downwardly and for preventing glare from disturbing a person standing or sitting in the room. In another embodiment, the louvered devices are omitted and three reflectors are provided, namely, two spaced-apart downwardly curved reflectors above the lamp and between which light projects upwardly directly from the lamp to the ceiling, and an upwardly curved reflector below the lamp for reflecting light from the lamp upwardly to the aforementioned two reflectors for subsequent downward reflection by the latter onto the work surface.

U.S. Pat. No. 3,746,854 discloses a lighting unit or luminair employing a lamp, such as an incandescent lamp, a gas discharge light, or a fluroescent light, in conjunction with a reflector of specified configuration which provides for a precise distribution of light over a precise relatively wide area outdoors.

However, disposition of louvers, baffles, reflectors, and the like in a light path for directional control and use of incandescent and fluorescent lights impair lighting efficiency. Furthermore, some prior art reflectors, designed to achieve certain directional and distribution effects, do so at the expense of overall lighting efficiency, even though high-intensity lamps, such as metal halide and high-pressure sodium lamps, are used in conjunction with reflectors made of specular materials.

SUMMARY OF THE PRESENT INVENTION

A lighting unit in accordance with the present invention comprises a lamp and a reflector and is advantageously employed in a variety of lighting systems to provide high intensity, highly efficient, even illumination over an area or work surface of particular size and shape and has a preferred cutoff angle to enable a person to work or approach relatively close to the lighting unit without seeing the lamp or lamp reflection.

The reflector comprises at least two reflector segments (such as side segments located on opposite sides of the lamp axis), each having spaced apart first and second edges and a reflector surface between those edges. The outer edges of the two reflector segments are spaced apart from each other and are located in a front plane on the front side of the lamp, which front plane coincides with or defines the reflector or opening. The inner edges of the two reflector segments are adjacent each other, joining together at their rear edges along a line behind the lamp in a rear plane on the rear side of and spaced from the lamp. Each point on a curve defined by a cross-section plane extending transverse to the lamp axis and intersecting the reflector surface of a reflector segment, is spaced farther away from the lamp than the rear edge of that reflector segment. Some points on this curve are located on that side of the rear plane which is remote from the lamp. This arrangement enables light emanating from the rear of the lamp to be reflected by the rear of the reflector to side portions of the reflector and from thence out of the reflector, thereby enhancing lighting efficiency.

In one lighting system disclosed, one embodiment of the lighting unit is mounted so as to project light upwardly for downward reflection from a ceiling onto a work area or work surface therebelow and the reflector opening is at or near eye level of a standing person. The lamp, which provides relatively high lumens per watt of electrical energy, such as a mercury metal halide or a high-pressure sodium lamp, includes an elongated glass envelope of circular cross section surrounding a light source therewithin. The reflector, which is fabricated of one or more pieces of specular reflective material, comprises eight interrelated curved reflector segments including: two side segments of the type hereinbefore described and located on opposite sides of the lamp and joined together along a line behind the lamp to reflect light emitted from the rear of the lamp; two end segments at opposite ends of the lamp; and four corner segments, each located between a side reflector and an end reflector. The said one embodiment, which employs the aforedescribed pair of side segments, also employs a pair of oppositely disposed spaced apart end segments, and two pairs of oppositely disposed spaced apart corner segments. Each of these segments has spaced apart outer and inner edges and a curved reflector surface therebetween, and each outer edge lies in an aforementioned front plane. The inner edges of the end and corner segments extend behind the lamp. Each point on a curve defined by a cross-section plane which is transverse to the lamp axis and intersects the curved reflector surface of an end or corner segment, is spaced farther from the lamp than the inner edge of the segment. The reflector and lamp cooperate to project light from the reflector opening in a generally circular pattern of even intensity and high efficiency at a cut-off angle of 35° with respect to a plane in which the reflector opening lies, in a highly efficient manner. The said one embodiment of the lighting unit can also be used to project light downwardly or horizontally, if desired.

In a second lighting system disclosed, a second embodiment of a lighting unit in accordance with the invention and employing a fluorescent tube is mounted so as to project light directly downwardly onto a work surface such as a desk or table top and the lighting unit is located so that the reflector opening is at or near the eye level of a person seated nearby. In this system, the lighting unit is located at a side of the desk. If preferred, two such lighting units can be located at opposite sides of the desk.

In a third lighting system disclosed, a third embodiment of a lighting unit, somewhat similar to the second embodiment but employing a pair of fluorescent tubes and a reflector therefor in accordance with the invention is provided.

In the said one embodiment, the curved reflector surfaces of the two side segments are of the same length and symmetrical. In the second and third embodiments, only two curved reflector surfaces are employed for each lamp and the two surfaces are not symmetrical and one is longer than the other.

Lighting units and systems in accordance with the invention offer several advantages over the prior art. For example, light is distributed area-wise and space-wise, at maximum efficiency and is evenly distributed. Furthermore, if the lighting unit is mounted so as to project light upwardly for reflection from a ceiling and is located so that the reflector opening is substantially at the eye level of a standing person, a person can approach relatively close to the lighting unit without being subjected to a direct view of the high intensity lamp or its reflection, thereby eliminating the need for light directing louvers or baffles which impair illumination efficiency. On the other hand, if the lighting unit is employed so as to direct light downwardly or laterally at a level which is near the eye level of a seated person, a person can be quite close to the lighting unit before the lamp or its reflection become visible. Lighting units in accordance with the invention employ commercially available readily obtainable lamps and electric power supplies therefor and employ reflectors which are easily and economically fabricated, either as one-piece units by vacuum from a suitable plastic material, or in discrete reflector segments which can be cut, shaped, and assembled from suitable specular sheet material, such as anodized aluminum or the like. Other objects and advantages of the invention will hereinafter appear.

DESCRIPTION OF PREFERRED EMBODIMENTS

First Embodiment

Figure 1:
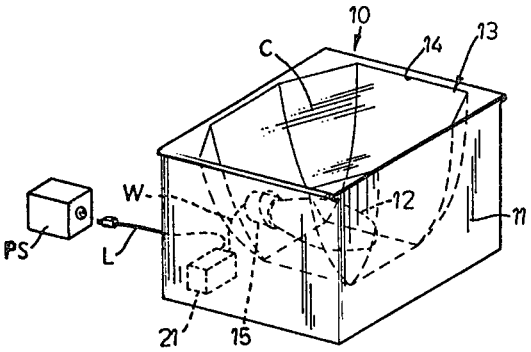
FIG. 1 is a perspective view of the upper side of one embodiment of a lighting unit in accordance with the present invention.

As FIG. 1 shows, a lighting unit 10 in accordance with one embodiment of the present invention comprises a lamp 12 and a reflector 13 disposed in an opaque-sided housing 11 having a removable protective transparent glass cover C. Unit 10 is advantageously employed in a variety of lighting systems to provide high intensity, highly efficient, even illumination over an area or work surface of particular size and shape and has a preferred cut-off angle of about 35°, to enable a person to work or approach relatively close to the lighting unit without seeing the lamp or lamp reflection.

Figure 2:
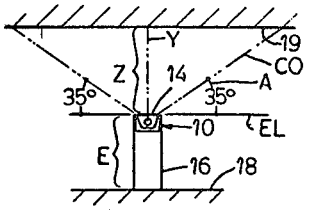
FIG. 2 is a schematic diagram on reduced scale showing a lighting unit according to FIG. 1 employed in a lighting system wherein light from the unit is directed upwardly for reflection from a ceiling and wherein the reflector opening of the lighting unit is located near eye level.
Figure 3:
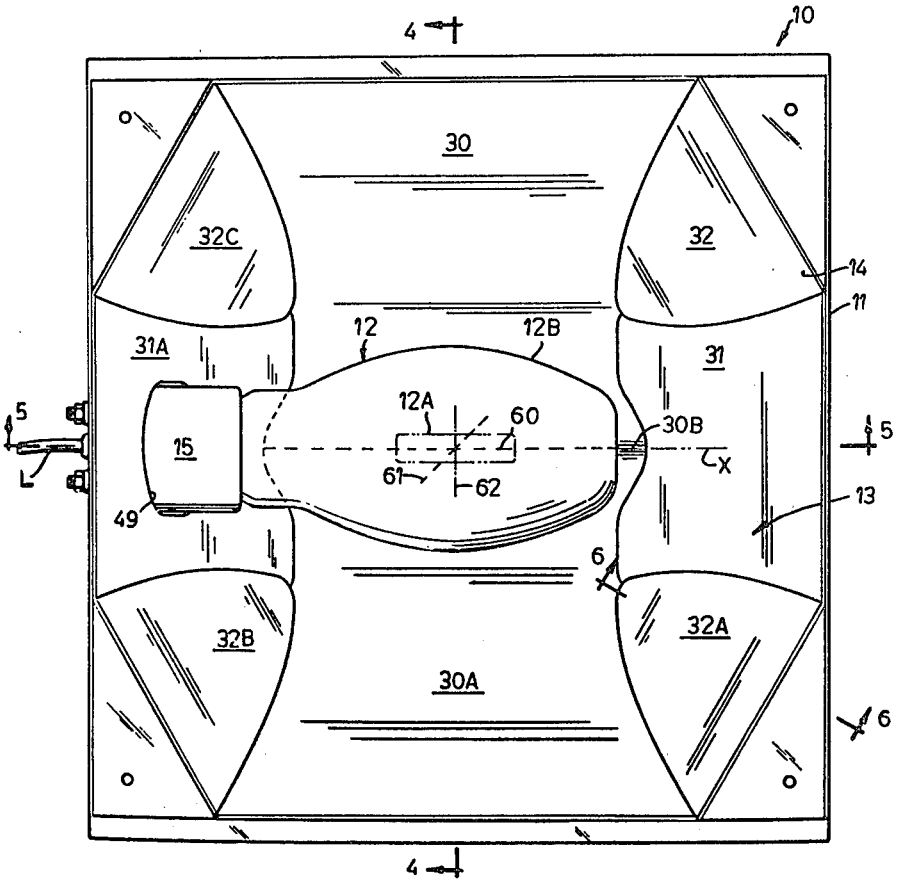
FIG. 3 is an enlarged top plan view of the interior of the lighting unit shown in FIGS. 1 and 2, with the glass cover plate of FIG. 1 removed and shows the lamp and reflector therein.

In one lighting system disclosed in FIG. 2, lighting unit 10 is mounted on a support 16 so as to project light upwardly in a cone CO along an optical axis Y for downward reflection from a ceiling 19 onto a work area or work surface therebelow, such as a floor 18, and the reflector opening 14 is at or near the eye level plane EL of a standing person. The lamp 12, which provides relatively high lumens per watt of electrical energy, such as a mercury metal halide or a high-pressure sodium lamp, includes an elongated glass envelope 12B of circular cross section surrounding a light source 12A therewithin. Lamp 12, which is supported in a socket 15, is energizable from an electric power source PS through a line cord L, a ballast 21, and wire cable W in a conventional manner.

As FIGS. 3, 4, 5, and 6 show, the reflector 13, which is fabricated of one or more pieces of specular reflective material, such as polished anodized aluminum or metal-coated Mylar (trademark), comprises eight interrelated curved reflector segments, namely: two side segments 30 and 30A on opposite sides of lamp 12 and joined together along a line 30B behind the lamp to reflect light emitted from the rear of the lamp; two end segments 31 and 31A at opposite ends of the lamp; and four corner segments 32, 32A. 32B, and 32C, each located between a side reflector and an end reflector. The reflector 13 and lamp 12 cooperate to project a cone of light CO from the reflector opening 14 onto ceiling 19 in a generally circular pattern of even intensity and high efficiency at a cut-off angle A of 35° between plane EL in which the reflector opening 14 lies and the side of cone CO, in a highly efficient manner. The lighting unit 10 can also be used to project light downwardly or horizontally, if desired.

The lamp reflector 13 comprises two reflector segments, such as side segments 30 and 30A located on opposite sides of the lamp axis X, each having a first edge 41 and second edge 42 spaced therefrom and a curved reflector surface 45 between those edges. The first (outer) edges 41 of the two side reflector segments 30 and 30A are spaced apart from each other and are located in a front plane 46 on one (front) side of the lamp 12, which is the plane in which the reflector opening 14 lies. The second inner edges 42 of the two side reflector segments 30 and 30A are adjacent each other and are located in another rear plane 47 behind or at the rear of the lamp 12 and are spaced from the lamp. Each point on a curve C1, shown in FIG. 4, defined by a plane extending transverse to the lamp axis X and intersecting the curved reflector surface 45 of a reflector segment 30 or 30A, is spaced farther away from the lamp 12 than the second inner edge 42 of that reflector segment. Some points on this curve C1 are located on the side of the other (rear) plane 47 which is remote from the lamp 12. The curved reflector surfaces 45 of the two side segments 30 and 30A ae of the same length and size and are symmetrical but reversely disposed.

Figure 4:
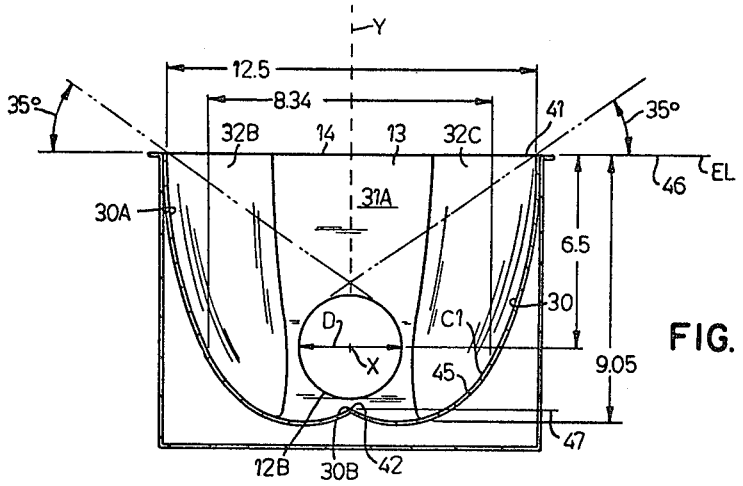
FIG. 4 is a cross-sectional view on reduced scale taken on line 4—4 of FIG. 3.
Figure 5:
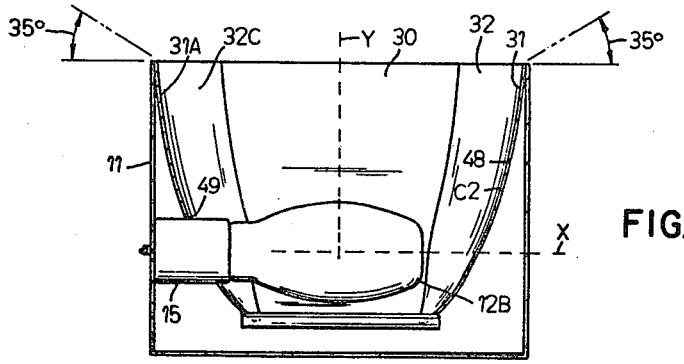
FIG. 5 is a cross-sectional view on reduced scale taken on line 5—5 of FIG. 3.
Figure 6:
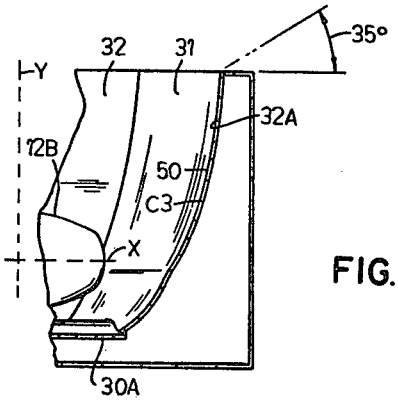
FIG. 6 is a cross-sectional view on reduced scale taken on line 6—6 of FIG. 3.

Each of the end segments 31 and 31A and each of the corner segments 32, 32A, 32B, and 32C also has a first (outer) edge 41 and a second (inner) edge 42 spaced therefrom. The end segments and corner segments have curved reflector surfaces 48 and 49, respectively. Each outer edge 41 lies in the aforementioned front plane 46. The inner edges 42 of the end segments 31 and 31A and the corner segments 32, 32A, 32B, and 32C extend behind the lamp, as FIGS. 4, 5, and 6 show. The end segments 31 and 31A are identical in size and configuration to each other, except for a lamp socket hole 49 in end segment 31A, but are reversely disposed. Similarly, the corner segments are similar to each other. Each point on a curve C2 defined by a plane which is transverse to the lamp axis X and intersects the curved reflector surface 48 of an end segment 31, 31A, is spaced farther from the lamp 12 than the inner edge of the end segment, as FIG. 5 shows.

Each point on a curve C3 defined by a plane which is transverse to the lamp axis X and intersects the curved reflector surface 50 of a corner segment 32, 32A, 32B, 32C, is spaced farther from the lamp 12 than the inner edge of the corner segment, as FIG. 6 shows.

With lighting unit 10 mounted as shown in FIG. 2, so as to project light upwardly for reflection from ceiling 19 and located so that the reflector opening 14 is substantially at the eye level EL of a standing person, a person can approach relatively close to the lighting unit without being subjected to a direct view of the high intensity lamp 12 or its reflection in reflector 13, thereby eliminating the need for light directig louvers or baffles which impair illumination efficiency.

As FIGS. 4, 5, and 6 make clear, radiation lines directly from lamp 12 exit directly through opening 14 of reflector 13. Radiation lines emitted from lamp 12 onto reflector 13 also exit from opening 14. Radiation lines emanating from the rear of lamp 12 are reflected once and in some cases at least twice from reflector 13 before being emitted through opening 14, thereby increasing lighting efficiency. However, no radiation line emitted from opening 14 is less than 35° above plane EL in FIG. 2.

Figure 7:
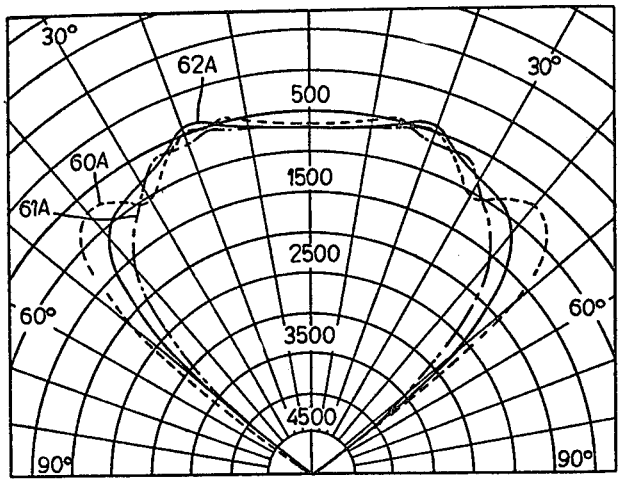
FIG. 7 is a graph depicting the light distribution pattern and candle power of the lighting unit shown in FIGS. 1 through 6.

FIG. 7 shows a graph base on actual tests and depicting the light distribution pattern and candle power at various points relative to a lighting unit 10 of the size and type shown in FIGS. 1 through 6 and employing a 120 volt, 250 watt deluxe coated mercury lamp rated at 12,300 lumens, such lamp having an envelope 12B about 6¼ inches long and about 3½ inches in diameter. In the graph, the lines 60A, 61A, and 62A represent measurements made at distances along the horizontal axes X, 61, and 62, respectively, shown in top plan view in FIG. 3. The axes 61 and 62 are at 45° and 90°, respectively, to lamp axis X. In the graph, the 0° line lies along the optical axis Y and the 90° line lies in front plane 46. The units 500 through 4500 represent candelas. The graph shows that light distribution from lighting unit 10 is substantially even at all significant distances therefrom within the desired cone CO.

The chart No. 1 shown below is a tested candle power summary on which the graph in FIG. 7 is based.

The chart No. 2 shown below shows the tested zonal lumens and lamp and fixture efficiency percentages of light unit 10 and indicates that it provides an efficiency of 73.32% of lumens emanating from lamp 12 in conjunction with reflector 13.

Chart No. 1

| CANDLEPOWER SUMMARY | | | | | | OUTPUT |
|---|---|---|---|---|---|---|
| ANGLE | ACROSS | 67.5 | 45 | 22.5 | ALONG | LUMENS |
| 0 | 4320 | 4320 | 4320 | 4320 | 4320 | |
| 5 | 4312 | 4347 | 4342 | 4366 | 4379 | 415 |
| 10 | 4386 | 4407 | 4331 | 4371 | 4424 | |
| 15 | 4527 | 4504 | 4435 | 4439 | 4531 | 1257 |
| 20 | 4562 | 4476 | 4338 | 4292 | 4453 | |
| 25 | 4327 | 4385 | 4332 | 4103 | 4199 | 1951 |
| 30 | 4138 | 4055 | 4043 | 3559 | 3881 | |
| 35 | 4064 | 4148 | 3736 | 3622 | 4153 | 2291 |
| 40 | 3816 | 2265 | 3251 | 1887 | 4264 | |
| 45 | 3144 | 3431 | 2422 | 3269 | 3920 | 2184 |
| 50 | 2075 | 2413 | 1325 | 2334 | 2528 | |
| 55 | 654 | 1158 | 449 | 1035 | 997 | 878 |
| 60 | 57 | 93 | 67 | 99 | 122 | |
| 65 | 31 | 30 | 24 | 33 | 30 | 38 |
| 70 | 7 | 7 | 5 | 8 | 6 | |
| 75 | 4 | 4 | 3 | 4 | 3 | 4 |
| 80 | 1 | 1 | 1 | 2 | 1 | |
| 85 | 0 | 0 | 0 | 0 | 0 | 0 |
| 90 | 0 | 0 | 0 | 0 | 0 | |

Chart No. 2

| ZONAL LUMENS AND PERCENTAGES | | | |
|---|---|---|---|
| ZONE | LUMENS | % LAMP | % FIXTURE |
| 0–30 | 3623 | 29.46 | 40.18 |
| 0–40 | 5913 | 48.08 | 65.58 |
| 0–60 | 8975 | 72.97 | 99.53 |
| 0–90 | 9017 | 73.32 | 100.00 |
| 40–90 | 3104 | 25.24 | 34.42 |
| 60–90 | 42 | 0.34 | 0.47 |
| 90–180 | 0 | 0.00 | 0.00 |

Chart No. 2-continued

| ZONAL LUMENS AND PERCENTAGES | | | |
|---|---|---|---|
| ZONE | LUMENS | % LAMP | % FIXTURE |
| 0-180 | 9017 | 73.32 | 100.00 |
| ** EFFICIENCY = 73.32% ** | | | |

SECOND EMBODIMENT

Figure 8:
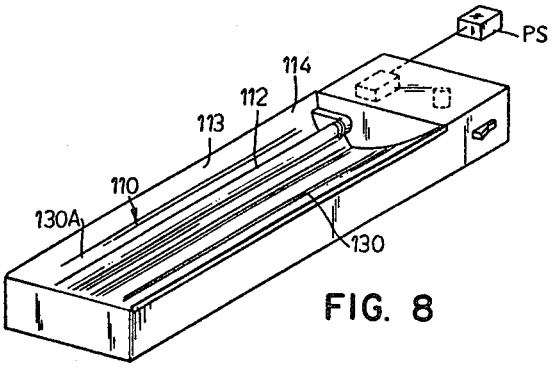
FIG. 8 is a perspective view of the lower side of a second embodiment of a lighting unit in accordance with the present invention.

As FIG. 8 shows, a lighting unit 110 in accordance with a second embodiment of the present invention comprises a lamp 112 and a reflector 113 disposed in an opaque-sided housing 111. Unit 110 is advantageously employed in a variety of lighting systems to provide high intensity, highly efficient, even illumination over an area or work surface of particular size and shape and has preferred cut-off angles of about 25° and 70° at its longitudinal edges, to enable a person to work or approach relatively close to the lighting unit without seeing the lamp or lamp reflection.

Figure 9:
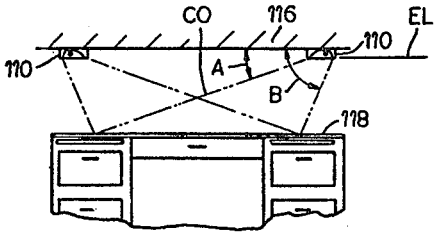
FIG. 9 is a schematic diagram on reduced scale showing two lighting units according to FIG. 8 employed in a lighting system wherein light from the units is directed downwardly onto a work surface and wherein the reflector opening of each lighting unit is located near eye level.
Figure 10:
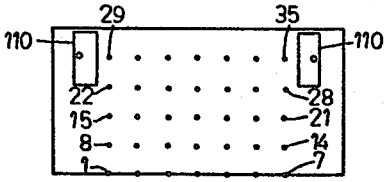
FIG. 10 is a top plan view of the lighting units and work surface of FIG. 9.

In a second lighting system disclosed in FIG. 9, two lighting units 110 are mounted on the underside of a support 116, such as a cabinet or shelf, so as to project light downwardly in two cones CO1 and CO2 onto a work area or work surface about 18 inches therebelow, such as a desk top 118, and the reflector opening 114 is at or near the eye level plane EL of a seated person. Preferably, the units 110 are located at the sides of the desk top 118, as FIGS. 9 and 10 show, so that they are not directly in front of the desk user. The lamp 112, such as a fluorescent tube, includes an elongated glass envelope 112B of circular cross section surrounding a light source therewithin. Lamp 112, which is supported in socket 115, is energizable from an electric power source PS through a line cord L, a transformer and ballast 121, and a wire cable W in a conventional manner.

Figure 11:
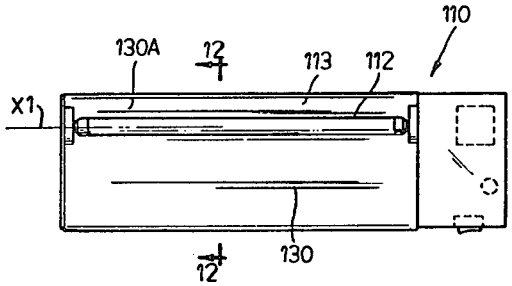
FIG. 11 is a bottom plan view of the interior of the lighting unit shown in FIGS. 8, 9, and 10, and shows the lamp and reflector therein.
Figure 12:
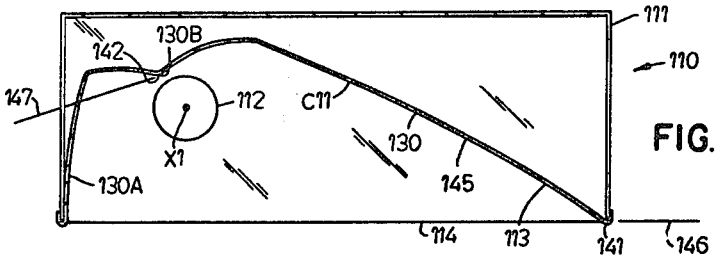
FIG. 12 is an enlarged cross-sectional view taken on line 12—12 of FIG. 11.

As FIGS. 8, 11, and 12 show, the reflector 113, which is fabricated of one or more pieces of specular reflective material, such as polished anodized aluminum or metal-coated Myler (trademark), comprises two interrelated curved reflector segments, namely: two side segments 130 and 130A on opposite sides of lamp 112 and joined together along a line 130B behind the lamp 112 to reflect light emitted from the rear of the lamp. The reflector 113 and lamp 112 cooperate to project a cone of light CO from the reflector opening 114 onto desk top 118 in a generally rectangular pattern of even intensity and high efficiency at a cut-off angle A of about 25° between plane EL in which the reflector opening 114 lies and one side of cone CO, and at a cut-off angle B of about 70° between plane EL and the other side of the cone, in a highly efficient manner. The lighting unit 110 can also be used to project light upwardly or horizontally, if desired.

The lamp reflector 113 comprises two reflector segments, such as side segments 130 and 130A located on opposite side of the lamp axis X1, each having a first edge 141 and second edge 142 spaced therefrom and a curved reflector surface 145 between those edges. The first (outer) edges 141 of the two side reflector segments 130 and 130A are spaced apart from each other and are located in a front plane 146 on one (front) side of the lamp 112, which is the plane in which the reflector opening 114 lies. The second inner edges 142 of the two side reflector segments 130 and 130A are adjacent each other and are located in another rear plane 147 behind or at the rear of the lamp 112 and are spaced from the lamp. Each point on a curve C11, shown in FIG. 12, defined by a plane extending transverse to the lamp axis X1 and intersecting the curved reflector surface 145 of a reflector segment 130 or 130A, is spaced farther away from the lamp 112 than the second inner edge 142 of that reflector segment. Some points on this curve C11 are located on the side of the other (rear) plane 147 which is remote from the lamp 112. The curved reflector surfaces 145 of the two side segments 130 and 130A are of different lengths and size, are not symmetrical, and are reversely disposed relative to each other.

With the lighting units 110 mounted as shown in FIGS. 9 and 10, so as to project light downwardly onto surface 118 and located so that the reflector openings 114 are substantially at the eye level EL of a seated person, a person can approach relatively close to the lighting units without being subjected to a direct view of the lamps 112 or their reflection in reflectors 113, thereby eliminating the need for light directing louvers or baffles which impair illumination efficiency.

As FIG. 12 makes clear, radiation lines directly from lamp 112 exit directly through opening 114 of reflector 113. Radiation lines emitted from lamp 112 onto reflector 113 also exit from opening 114. Radiation lines emanating from the rear of lamp 112 are reflected once and in some cases at least twice from reflector 113 before being emitted through opening 114, thereby increasing lighting efficiency. However, no radiation line emitted from opening 114 is less than about 25° below plane EL in FIG. 9.

Figure 13:
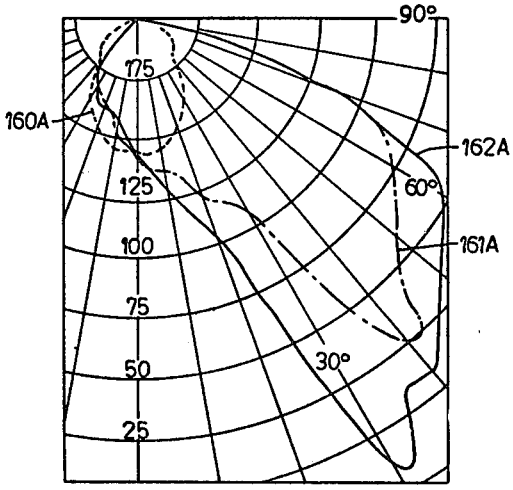
FIG. 13 is a graph depicting the light distribution pattern and candle power of the lighting unit shown in FIGS. 8 through 12.

FIG. 13 shows a graph based on actual tests and depicting the light distribution pattern and candle power at various points relative to a lighting unit 110 of the size shown in FIG. 12 and employing a 120 volt fluorescent tube lamp 112 rated at 400 lumens, such as a General Electric type F8T5CW fluorescent tube about $10\frac{1}{4}$ inches by $\frac{5}{8}$ inches in diameter. In the graph, the lines 160A, 161A, and 162A represent measurements made at distances along the horizontal axes X1, 161, and 162, respectively, shown in FIG. 11. The axes 161 and 162 are at 45° and 90°, respectively, to lamp axis X1. The graph shows that light distribution from lighting unit 110 is substantially even at all significant distances therefrom within the desired cone CO.

The chart No. 3 shown below is a tested candle power summary of the beam side of unit 110 and on which a portion of a graph in FIG. 13 is based.

The chart No. 4 shown below shows the tested zonal lumens and lamp and fixture efficiency percentages of both sides of light unit 110 and indicates that it provides an efficiency of 64.91% of lumens emanating from lamp 112 in conjunction with reflector 113.

The chart No. 5 shown below is similar to chart No. 3 but is a summary of the candle power on the side of unit 110 opposite the beam side.

The chart No. 6 shown below depicts measured light distribution patterns measured at the points designated 1 through 35 in desk surface 118 shown in FIGS. 9 and 10 which was 30 inches by 60 inches in size.

Chart No. 3

| CANDLEPOWER SUMMARY BEAM SIDE | | | | | | OUTPUT |
|---|---|---|---|---|---|---|
| ANGLE | ACROSS | 67.5 | 45 | 22.5 | ALONG | LUMENS |
| 0 | 56 | 56 | 56 | 56 | 56 | |
| 5 | 63 | 62 | 64 | 57 | 59 | 3 |
| 10 | 73 | 67 | 64 | 57 | 56 | |
| 15 | 84 | 76 | 69 | 55 | 52 | 10 |
| 20 | 97 | 86 | 80 | 54 | 49 | |

Chart No. 3-continued

| CANDLEPOWER SUMMARY BEAM SIDE | | | | | | OUTPUT |
|---|---|---|---|---|---|---|
| ANGLE | ACROSS | 67.5 | 45 | 22.5 | ALONG | LUMENS |
| 25 | 149 | 106 | 85 | 53 | 44 | 21 |
| 30 | 219 | 194 | 97 | 50 | 34 | |
| 35 | 191 | 184 | 151 | 52 | 33 | 39 |
| 40 | 190 | 173 | 177 | 50 | 22 | |
| 45 | 175 | 163 | 150 | 50 | 20 | 45 |
| 50 | 163 | 148 | 137 | 60 | 17 | |
| 55 | 153 | 136 | 129 | 81 | 17 | 48 |
| 60 | 144 | 128 | 119 | 73 | 16 | |
| 65 | 115 | 109 | 108 | 60 | 12 | 41 |
| 70 | 78 | 73 | 84 | 45 | 5 | |
| 75 | 33 | 36 | 48 | 31 | 0 | 18 |
| 80 | 0 | 1 | 13 | 12 | 0 | |
| 85 | 0 | 0 | 0 | 0 | 0 | 1 |
| 90 | 0 | 0 | 0 | 2 | 0 | |

Chart No. 4

| BOTH SIDES ZONAL LUMENS AND PERCENTAGES | | | |
|---|---|---|---|
| ZONE | LUMENS | % LAMP | % FIXTURE |
| 0–30 | 50 | 12.64 | 19.47 |
| 0–40 | 97 | 24.38 | 37.56 |
| 0–60 | 197 | 49.45 | 76.19 |
| 0–90 | 259 | 64.91 | 100.00 |
| 40–90 | 162 | 40.53 | 62.44 |
| 60–90 | 61 | 15.45 | 23.81 |
| 90–180 | 0 | 0.00 | 0.00 |
| 0–180 | 259 | 64.91 | 100.00 |

Chart No. 4-continued

| BOTH SIDES ZONAL LUMENS AND PERCENTAGES | | | |
|---|---|---|---|
| ZONE | LUMENS | % LAMP | % FIXTURE |
| ** EFFICIENCY = 64.91% ** | | | |

Chart No. 5

| OPPOSITE SIDE TO BEAM CANDLEPOWER DATA | | | | | | | |
|---|---|---|---|---|---|---|---|
| | | PLANE | | | | | |
| AN-GLE | A-CROSS | 67.5 | 45 | 22.5 | A-LONG | AVER-AGE | OUTPUT LUMENS |
| 0 | 55 | 55 | 55 | 55 | 55 | 55 | |
| 5 | 48 | 50 | 52 | 53 | 56 | 52 | 2 |
| 10 | 42 | 46 | 49 | 50 | 55 | 48 | |
| 15 | 38 | 42 | 40 | 46 | 52 | 43 | 6 |
| 20 | 39 | 42 | 37 | 41 | 49 | 41 | |
| 25 | 38 | 44 | 36 | 35 | 45 | 39 | 9 |
| 30 | 31 | 40 | 28 | 23 | 37 | 31 | |
| 35 | 29 | 36 | 32 | 24 | 33 | 31 | 8 |
| 40 | 14 | 17 | 18 | 11 | 21 | 16 | |
| 45 | 5 | 9 | 14 | 15 | 21 | 13 | 5 |
| 50 | 0 | 2 | 9 | 16 | 22 | 10 | |
| 55 | 0 | 0 | 5 | 16 | 19 | 8 | 3 |
| 60 | 0 | 2 | 0 | 14 | 19 | 6 | |
| 65 | 0 | 0 | 0 | 8 | 13 | 4 | 2 |
| 70 | 0 | 1 | 0 | 2 | 9 | 2 | |
| 75 | 0 | 2 | 0 | 0 | 3 | 1 | 1 |
| 80 | 0 | 2 | 0 | 0 | 0 | 1 | |
| 85 | 0 | 0 | 0 | 0 | 0 | 0 | 0 |

Chart No. 6

DISTANCES ARE MEASURED FROM THE LEFT REAR CORNER OF THE ROOM. X IS THE DISTANCE IN FEET ACROSS THE ROOM, Y IS ALONG THE ROOM

VIEWER ORIENTATION IS 0.0 DEGREES FOR VIEWING ALONG THE ROOM, +90 IS VIEWING TOWARDS THE LEFT WALL, −90 IS VIEWING TOWARDS THE RIGHT WALL.

FC* IS THE FOOTCANDLE LIGHT FOR NO BODY SHADOW. ALL OTHER VALUES INCLUDE BODY SHADOW. LB AND LT ARE THE LUMINANCES OF THE BACKGROUND AND TASK RESPECTIVELY.

| | LOCATION | | ORIENTATION | | | | | | | |
|---|---|---|---|---|---|---|---|---|---|---|
| | X | Y | ANGLE | FC* | FC | LB | LT | CRF | ESI | LEF |
| 1 | 1.00 | 12.50 | 0.0 | 17.58 | 17.19 | 16.11 | 13.42 | 0.997 | 18.78 | 1.92 |
| 2 | 1.50 | 12.50 | 0.0 | 19.98 | 19.61 | 18.12 | 14.90 | 1.061 | 30.57 | 1.559 |
| 3 | 2.00 | 12.50 | 0.0 | 20.95 | 20.59 | 18.75 | 15.28 | 1.106 | 41.33 | 2.007 |
| 4 | 2.50 | 12.50 | 0.0 | 21.25 | 20.89 | 18.91 | 15.35 | 1.123 | 46.47 | 2.225 |
| 5 | 3.00 | 12.50 | 0.0 | 20.95 | 20.59 | 18.75 | 15.28 | 1.106 | 41.33 | 2.007 |
| 6 | 3.50 | 12.50 | 0.0 | 19.98 | 19.61 | 18.12 | 14.90 | 1.061 | 30.57 | 1.559 |
| 7 | 4.00 | 12.50 | 0.0 | 17.58 | 17.19 | 16.11 | 13.42 | 0.997 | 18.78 | 1.092 |
| 8 | 1.00 | 13.00 | 0.0 | 28.26 | 27.87 | 26.48 | 22.52 | 0.894 | 16.31 | 0.585 |
| 9 | 1.50 | 13.00 | 0.0 | 31.22 | 30.85 | 28.42 | 23.53 | 1.027 | 39.91 | 1.294 |
| 10 | 2.00 | 13.00 | 0.0 | 30.64 | 30.28 | 27.18 | 22.23 | 1.088 | 57.76 | 1.907 |
| 11 | 2.50 | 13.00 | 0.0 | 29.72 | 29.36 | 26.12 | 21.27 | 1.110 | 64.74 | 2.205 |
| 12 | 3.00 | 13.00 | 0.0 | 30.64 | 30.28 | 27.18 | 22.23 | 1.088 | 57.76 | 1.907 |
| 13 | 3.50 | 13.00 | 0.0 | 31.22 | 30.85 | 28.42 | 23.53 | 1.027 | 39.91 | 1.294 |
| 14 | 4.00 | 13.00 | 0.0 | 28.26 | 27.87 | 26.48 | 22.52 | 0.894 | 16.31 | 0.585 |
| 15 | 1.00 | 13.50 | 0.0 | 46.81 | 46.42 | 43.85 | 37.94 | 0.805 | 13.93 | 0.300 |
| 16 | 1.50 | 13.50 | 0.0 | 48.31 | 47.94 | 43.35 | 36.11 | 0.996 | 49.91 | 1.041 |
| 17 | 2.00 | 13.50 | 0.0 | 42.67 | 42.31 | 37.07 | 30.39 | 1.076 | 76.43 | 1.806 |
| 18 | 2.50 | 13.50 | 0.0 | 39.99 | 39.63 | 34.31 | 28.03 | 1.093 | 78.49 | 1.981 |
| 19 | 3.00 | 13.50 | 0.0 | 42.67 | 42.31 | 37.07 | 30.39 | 1.076 | 76.43 | 1.806 |
| 20 | 3.50 | 13.50 | 0.0 | 48.31 | 47.94 | 43.35 | 36.11 | 0.996 | 49.91 | 1.041 |
| 21 | 4.00 | 13.50 | 0.0 | 46.81 | 46.42 | 43.85 | 37.94 | 0.805 | 13.93 | 0.300 |
| 22 | 1.00 | 14.00 | 0.0 | 69.32 | 68.94 | 62.26 | 53.70 | 0.821 | 19.82 | 0.287 |
| 23 | 1.50 | 14.00 | 0.0 | 66.15 | 65.78 | 57.24 | 47.75 | 0.990 | 62.55 | 0.951 |
| 24 | 2.00 | 14.00 | 0.0 | 53.75 | 53.39 | 45.25 | 37.13 | 1.072 | 90.13 | 1.688 |
| 25 | 2.50 | 14.00 | 0.0 | 49.78 | 49.43 | 41.37 | 33.85 | 1.084 | 89.60 | 1.813 |
| 26 | 3.00 | 14.00 | 0.0 | 53.75 | 53.39 | 45.25 | 37.13 | 1.072 | 90.13 | 1.688 |
| 27 | 3.50 | 14.00 | 0.0 | 66.15 | 65.78 | 57.24 | 47.75 | 0.990 | 62.55 | 0951 |
| 28 | 4.00 | 14.00 | 0.0 | 69.32 | 68.94 | 62.26 | 53.70 | 0.821 | 19.82 | 0287 |
| 29 | 1.00 | 14.50 | 0.0 | 80.42 | 80.03 | 67.98 | 57.61 | 0.910 | 40.01 | 0500 |
| 30 | 1.50 | 14.50 | 0.0 | 74.07 | 73.71 | 61.19 | 50.80 | 1.014 | 80.16 | 1.088 |
| 31 | 2.00 | 14.50 | 0.0 | 58.74 | 58.38 | 47.69 | 39.08 | 1.078 | 97.91 | 1.677 |
| 32 | 2.50 | 14.50 | 0.0 | 54.20 | 53.84 | 43.54 | 35.59 | 1.090 | 97.83 | 1.817 |

Chart No. 6-continued

DISTANCES ARE MEASURED FROM THE LEFT REAR CORNER OF THE ROOM. X IS THE DISTANCE IN FEET ACROSS THE ROOM, Y IS ALONG THE ROOM

VIEWER ORIENTATION IS 0.0 DEGREES FOR VIEWING ALONG THE ROOM, +90 IS VIEWING TOWARDS THE LEFT WALL, −90 IS VIEWING TOWARDS THE RIGHT WALL.

FC* IS THE FOOTCANDLE LIGHT FOR NO BODY SHADOW. ALL OTHER VALUES INCLUDE BODY SHADOW. LB AND LT ARE THE LUMINANCES OF THE BACKGROUND AND TASK RESPECTIVELY.

| | LOCATION | | ORIENTATION | | | | | | | |
|---|---|---|---|---|---|---|---|---|---|---|
| | X | Y | ANGLE | FC* | FC | LB | LT | CRF | ESI | LEF |
| 33 | 3.00 | 14.50 | 0.0 | 58.74 | 58.38 | 47.69 | 39.08 | 1.078 | 97.91 | 1.677 |
| 34 | 3.50 | 14.50 | 0.0 | 74.07 | 73.71 | 61.19 | 50.80 | 1.014 | 80.16 | 1.088 |
| 35 | 4.00 | 14.50 | 0.0 | 80.42 | 80.03 | 67.98 | 57.61 | 0.910 | 40.01 | 0.500 |
| | | | AVERAGE= | 44.93 | | | | | 52.80 | 1.303 |
| | | | MAXIMUM= | 80.42 | | | | | 97.91 | 2.225 |
| | | | MINIMUM= | 17.58 | | | | | 13.93 | 0.287 |

AVERAGES BY DIRECTION:

| | |
|---|---|
| ORIENTATION | 0. |
| AVERAGE | 52.80 |
| MAXIMUM | 97.91 |
| MINIMUM | 13.93 |

NO ESI CALCULATION PROCEDURES FOR TASK LIGHTING HAVE BEEN ESTABLISHED YET BY IES.

THIRD EMBODIMENT

Figure 14:
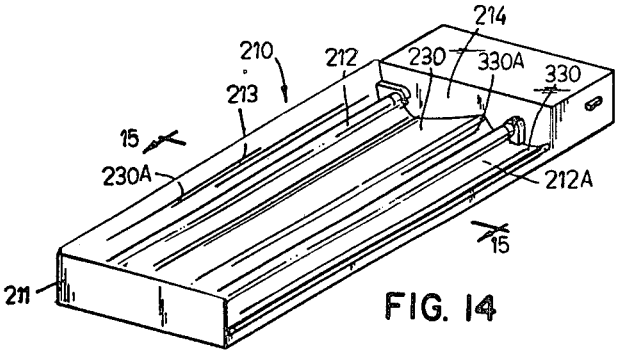
FIG. 14 is a perspective view of the lower side of a third embodiment of a lighting unit in accordance with the present invention.

As FIG. 14 shows, a lighting unit 210 in accordance with a third embodiment of the present invention comprises two lamps 212 and 212A, each similar to fluorescent lamp 112 hereinbefore-described, and a reflector 413 disposed in an opaque-sided housing 211. Unit 210 is advantageously employed in a variety of lighting systems to provide high intensity, highly efficient, even illumination over an area or work surface of particular size and shape and has preferred cut-off angles shown in the graph in FIG. 16, to enable a person to work or approach relatively close to the lighting unit without seeing the lamp or lamp reflection.

One or more lighting units 210 can be mounted in the same manner as unit 110 hereinbefore described so as to project light downwardly in a cone CO onto a work area or work surface therebelow, such as the desk top 118 shown in FIGS. 9 and 10, and the reflector opening 214 is at or near the eye level plane EL of a seated person.

Figure 15:
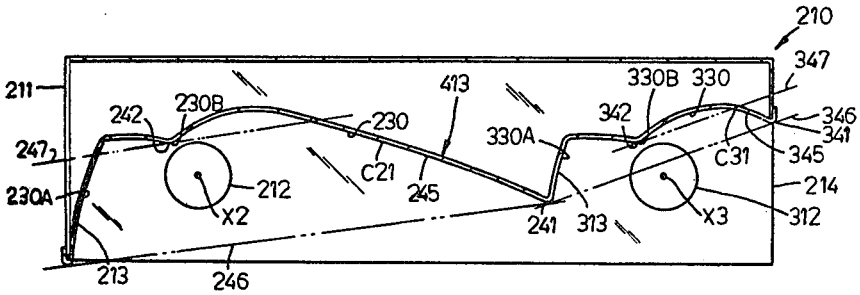
FIG. 15 is an enlarged cross-sectional view taken on line 15—15 of FIG. 14.

As FIGS. 14 and 15 show, the reflector 413, which is fabricated of one or more pieces of specular reflective material, such as polished anodized aluminum or metal-coated Mylar (trademark), comprises four interrelated curved reflector segments, namely: two side segments 230 and 230A on opposite sides of lamp 212 and joined together along a line 230B behind the lamp 212 to reflect light emitted from the rear of the lamp 212, and two additional side segments 330 and 330A on opposite sides of lamp 312 and joined together along a line 330B behind lamp 312 to reflect light from the rear of lamp 312. The reflector 413 and lamps 212 and 312 cooperte to project a cone of light CO from the reflector opening 214 onto desk top 118 in a generally rectangular pattern of even intensity and high efficiency at a preferred cut-off angle A of about 25° between plane EL in which the reflector opening 214 lies and one side of cone CO (see FIG. 15), and at a cut-off angle B of about 75° between plane EL and the other side of the cone in a highly efficient manner. The lighting unit 210 can also be used to project light upwardly or horizontally, if desired.

The two reflector side segments 230 and 230A are located on opposite sides of the lamp axis X2, each having a first edge 241 and second edge 242 spaced therefrom and a curved reflector surface 245 between those edges. The first outer edges 241 of the two side reflector segments 230 and 230A are spaced apart from each other and are located in a front plane 246 on one (front) side of the lamp 212, which is the plane in which the reflector opening 214 lies. The second inner edges 242 of the two side reflector segments 230 and 230A are adjacent each other and are located in another rear plane 247 behind or at the rear the lamp 212 and are spaced from the lamp 212. Each point on a curve C21, shown in FIG. 15, defined by a plane extending transverse to the lamp axis X and intersecting the curved reflector surface 245 of a reflector segment 230 or 230A, is spaced farther away from the lamp 212 than the second inner edge 242 of that reflector segment. Some points on this curve C21 are located on the side of the other (rear) plane 247 which is remote from the lamp 212. The curved reflector surfaces 245 of the two side segments 230 and 230A are of different lengths and size, are not symmetrical, and are reversely disposed relative to each other.

The two reflector side segments 330 and 330A are located on opposite sides of the lamp axis X3, each having a first edge 341 and a second edge 342 spaced therefrom and a curved reflector surface 345 between those edges. The first (outer) edges 341 of the two side reflector segments 330 and 330A are spaced apart from each other and are located in a front plane 346 on one (front) side of the lamp 312, which is the plane in which the reflector opening 314 lies. The second inner edges 342 of the two side reflector segments 330 and 330A are adjacent each other and are located in another rear plane 347 behind or at the rear of the lamp 312 and are spaced from the lamp 312. Each point on a curve C31, shown in FIG. 15, defined by a plane extending transverse to the lamp axis X3 and intersecting the curved reflector surface 345 of a reflector segment 330 or 330A, is spaced farther away from the lamp 312 than the second inner edge 342 of that reflector segment. Some points on this curve C31 are located on the side of other (rear) plane 347 which is remote from the lamp 312. The curved reflector surfaces 345 of the two side segments 330 and 330A are of different lengths and size, are not symmetrical, and are reversely disposed relative to each other.

With lighting units 210 mounted like units 110, as shown in FIGS. 9 and 10, so as to project light downwardly onto surface 118 and located so that the reflector openings 214 are substantially at the eye level EL of a standing person, a person can approach relatively close to the lighting unit without being subjected to a direct view of the lamps or their reflection in reflector 413, thereby eliminating the need for light directing louvers or baffles which impair illumination efficiency.

Figure 16:
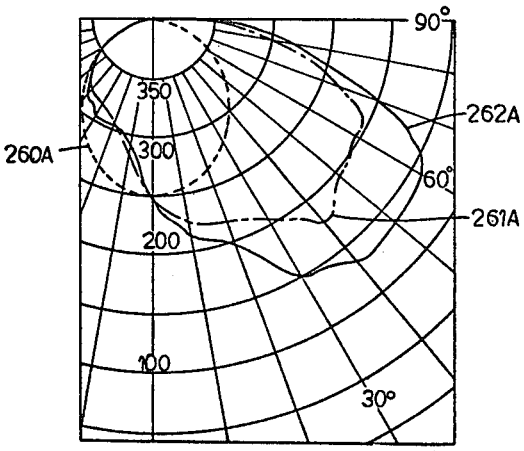
FIG. 16 is a graph depicting the light distribution pattern and candle power of the lighting unit shown in FIGS. 14 and 15.

FIG. 16 shows a graph based on actual tests depicting candle power at various points relative to a lighting unit 210 of the size shown in FIG. 15 and employing two fluorescent tubes of the type described. In the graph, the lines 260A, 261A, and 262A represent measurements made at distances along the lamp axes X2, X3 and 261, and 262, respectively, shown in FIG. 14. The axes 261 and 262 are at 45° and 90°, respectively, to axes X2, X3. The graph shows that light distribution from lighting unit 210 is substantially even at all significant distances therefrom within the desired cone.

The chart No. 7 shown below is a candle power summary on which the graph in FIG. 16 is based.

The chart No. 8 shown below shows the tested zonal lumens and lamp and fixture efficiency percentages of light unit 210 and indicates that it provides an efficiency of 77.48% of lumens emanating from the lamps 212 and 312 in conjunction with reflector 413.

Chart No. 7

| CANDLEPOWER SUMMARY BEAM SIDE | | | | | | OUTPUT |
|---|---|---|---|---|---|---|
| ANGLE | ACROSS | 67.5 | 45 | 22.5 | ALONG | LUMENS |
| 0 | 152 | 152 | 152 | 152 | 152 | |
| 5 | 171 | 170 | 166 | 157 | 149 | 8 |
| 10 | 185 | 182 | 176 | 163 | 146 | |
| 15 | 194 | 189 | 181 | 165 | 142 | 25 |
| 20 | 203 | 196 | 183 | 162 | 135 | |
| 25 | 225 | 213 | 187 | 160 | 129 | 43 |
| 30 | 252 | 239 | 199 | 157 | 122 | |
| 35 | 254 | 245 | 206 | 148 | 110 | 62 |
| 40 | 266 | 257 | 224 | 150 | 101 | |
| 45 | 265 | 250 | 214 | 141 | 88 | 76 |
| 50 | 263 | 249 | 203 | 134 | 76 | |
| 55 | 260 | 247 | 201 | 129 | 66 | 83 |
| 60 | 256 | 244 | 196 | 120 | 54 | |
| 65 | 235 | 225 | 189 | 109 | 43 | 80 |
| 70 | 195 | 189 | 162 | 95 | 29 | |
| 75 | 151 | 148 | 134 | 85 | 17 | 59 |
| 80 | 119 | 112 | 91 | 65 | 7 | |
| 85 | 90 | 84 | 65 | 37 | 1 | 32 |
| 90 | 62 | 56 | 42 | 22 | 0 | |

Chart No. 8

| BOTH SIDES ZONAL LUMENS AND PERCENTAGES | | | |
|---|---|---|---|
| ZONE | LUMENS | % LAMP | % FIXTURE |
| 0–30 | 120 | 15.07 | 19.45 |
| 0–40 | 209 | 26.22 | 33.84 |
| 0–60 | 420 | 52.62 | 67.92 |
| 0–90 | 619 | 77.48 | 100.00 |
| 40–90 | 410 | 51.26 | 66.16 |
| 60–90 | 198 | 24.86 | 32.08 |
| 90–180 | 0 | 0.00 | 0.00 |
| 0–180 | 619 | 77.48 | 100.00 |
| ** EFFICIENCY = 77.48% ** | | | |

I claim:

1. In a lighting system:

a room having a floor and a ceiling:

and a lighting unit comprising a lamp and a reflector having a plurality of curved reflector surfaces, said reflector having an opening in a frontal plane defined by the edges of said curved reflector surfaces, said frontal plane being substantially parallel to said floor of said room;

said lighting unit being positioned on said floor in said room for projecting a cone of light emanating from said opening upwardly toward said ceiling for reflection downwardly therefrom;

said lighting unit being located so that said frontal plane is positioned at a distance above said floor which is about that of the average eye level of a standing human being;

said cone of light emanating from opening defining an angle of about 35° between the edge thereof and said frontal plane thereby to minimize glare to human beings present in said room.

2. In a lighting system:

a room having a floor and a ceiling and a lighting unit comprising a lamp and a reflector having a plurality of reflector surfaces, said reflector having an opening in a frontal plane defined by the edges of said reflector surfaces;

said lighting unit being mounted to project a cone of light emanating from said opening upwardly toward said ceiling for reflection downwardly therefrom;

said lighting unit being located so that said frontal plane is at a distance above said floor which is about that of the average eye level of a standing human being;

said cone of light defining an angle of about 35° between the edge thereof and said frontal plane, wherein said lamp has a longitudinal lamp axis and wherein said reflector comprises at least two curved reflector surfaces, each having first and second spaced ends, the first ends of said reflector surfaces joining each other along a line located in a plane behind and spaced from said lamp, said line of joinder of said first ends of said reflector surfaces extending substantially parallel to the longitudinal axis of said lamp, the second ends of said reflector surfaces extending outwardly and away from said lamp at the front thereof, said second ends being spaced from each other and lying in said frontal plane;

each point on the curve of said reflector surfaces being defined by a plane extending transverse to the longitudinal axis of said lamp, said points on said reflector surfaces being spaced farther from the longitudinal axis of said lamp than said line of joinder of said front ends of said reflector surfaces, with some points on said curve being located on the side of said lamp opposite said line of joinder of said first ends of said reflector surfaces.

3. In a lighting system:

a room having a floor and a ceiling and a lighting unit comprising a lamp and a reflector having a plurality of reflector surfaces, said reflector having an opening in a frontal plane defined by the edges of said reflector surfaces;

said lighting unit being mounted to project a cone of light emanating from said opening upwardly toward said ceiling for reflection downwardly therefrom;

said lighting unit being located so that said frontal plane is at a distance above said floor which is about that of the average eye level of a standing human being;

said cone of light defining an angle of about 35° between the edge thereof and said frontal plane, wherein said lamp comprises an elongated lamp having a longitudinal lamp axis; and wherein said reflector comprises a plurality of curved reflector surfaces including a pair of oppositely disposed spaced apart side surfaces, a pair of oppositely disposed spaced apart end surfaces, and two pairs of oppositely disposed spaced apart corner surfaces;

said side surfaces each having first and second spaced ends, the first ends of said reflector surfaces being joined to each other along a line located in a plane behind and spaced from said lamp, said line of joinder of said first ends of said reflector surfaces extending substantially parallel to the longitudinal axis of said lamp, the second ends of said reflector surfaces extending outwardly and away from said lamp at the front thereof, said second ends being spaced from each other and lying in said frontal plane, each point on the curve of said side reflector surfaces being defined by a plane extending transverse to the longitudinal axis of said lamp said points on said curved reflector surfaces being spaced farther from the longitudinal axis of said lamp than said line of joinder of said first ends of said reflector surfaces, with some points on each curve of each said side surface being located on the side of said lamp opposite said line of joinder of said first ends of said side reflector surfaces.

4. A lighting system according to claim 3 wherein said lamp is a high-intensity lamp.

5. In a lighting system:

a room having a floor and a ceiling;

a substantially planar work surface in said room elevated above said floor;

and at least one lighting unit comprising a lamp and a reflector including a plurality of curved reflector surfaces;

said reflector having an opening in a frontal plane defined by the edges of said curved reflector surfaces;

said lighting unit being positioned above said work surface for projecting a cone of light emanating from said opening downwardly directly onto said work surface, said frontal plane being substantially parallel to said work surface;

said frontal plane of said lighting unit being at a distance above said work surface which is about that of the average eye level of a human being seated near said work surface;

said cone of light emanating from said opening defining an angle of about 70° between the edge thereof farthest from said seated person and said frontal plane;

said cone of light emanating from said opening defining an angle of about 25° between the edge thereof nearest to said seated person and said frontal plane.

6. A lighting system according to claim 5 including two of said lighting units, one near each lateral end of said work surface, and located so that the cones of light therefrom overlap each other.

7. In a lighting system:

a room having a floor and a ceiling;

a work surface in said room elevated above said floor;

and at least one lighting unit comprising a lamp and a reflector comprising a plurality of curved reflector surfaces, said reflector having an opening in a frontal plane defined by the edges of said curved reflector surfaces, said lighting unit being mounted so as to project a cone of light emanating from said opening downwardly directly onto said work surface;

said lighting unit being located so that said frontal plane is at a distance above said work surface which is about that of the average eye level of a human being seated near said work surface;

said cone of light defining an angle of about 70° between the edge thereof farthest from said seated person and said frontal plane, said cone of light defining an angle of about 25° between the edge thereof nearest to said seated person and said frontal plane, and wherein said lamp has a longitudinal lamp axis; and said lamp reflector comprises at least two surfaces each having first and second spaced ends, the first ends of said reflector surfaces joining each other along a line located in a plane behind and spaced from said lamp, said line of joinder of said first ends of said reflector surfaces extending substantially parallel to the longitudinal axis of said lamp, the second ends of said reflector surfaces extending outwardly and away from said lamp at the front thereof, said second ends being spaced from each other and lying in said frontal plane at least one of said reflector surfaces being curved;

each point on the curve of said curved reflector surface being defined by a plane extending transverse to the longitudinal axis of said lamp, said points on said reflector surface being spaced farther from the longitudinal axis of said lamp than said line of joinder of said first end of said reflector surface, with some points on said curve being located on the side of said lamp opposite said line of joinder of said first ends of said reflector surfaces.

* * * * *